US006390518B1

(12) United States Patent
Elick

(10) Patent No.: US 6,390,518 B1
(45) Date of Patent: May 21, 2002

(54) LATCHING MECHANISM FOR AN APPLIANCE DOOR

(75) Inventor: Robert A. Elick, Jackson, TN (US)

(73) Assignee: Maytag Corporation, Newton, IA (US)

( * ) Notice: Subject to any disclaimer, the term of this patent is extended or adjusted under 35 U.S.C. 154(b) by 32 days.

(21) Appl. No.: 09/637,379

(22) Filed: Aug. 15, 2000

(51) Int. Cl.[7] ..... E05C 3/06; E05C 3/16

(52) U.S. Cl. ..... 292/216; 292/96; 292/97; 292/117; 292/122; 292/123; 292/196; 292/198; 292/214; 292/220; 292/223; 292/DIG. 24; 292/DIG. 41; 292/DIG. 69

(58) Field of Search ..... 292/216, DIG. 69, 292/214, 117, 220, 223, 196, 198, 122, 123, 96, 97, DIG. 24, DIG. 41

(56) References Cited

U.S. PATENT DOCUMENTS

| | | | | | |
|---|---|---|---|---|---|
| 2,193,132 | A | * | 3/1940 | Hynes | 292/11 |
| 3,328,062 | A | * | 6/1967 | Geiger et al. | 292/123 |
| 3,836,185 | A | * | 9/1974 | Touchstone | 292/1 |
| 3,912,891 | A | * | 10/1975 | Mercer et al. | 200/61.67 |
| 3,997,201 | A | | 12/1976 | Deschaaf et al. | |
| 4,073,519 | A | * | 2/1978 | Kurozu et al. | 292/216 |
| 4,082,078 | A | | 4/1978 | Thulleen et al. | |
| 4,105,229 | A | | 8/1978 | Kaldenberg | |
| 4,268,076 | A | | 5/1981 | Itoi | |
| 4,510,777 | A | | 4/1985 | Ellingson et al. | |
| 4,679,836 | A | * | 7/1987 | Pupillo et al. | 292/216 |
| 4,776,620 | A | * | 10/1988 | Marks et al. | 292/228 |
| 4,880,263 | A | * | 11/1989 | Yamada | 292/216 |
| 5,174,618 | A | | 12/1992 | Kropf | |
| 5,234,238 | A | * | 8/1993 | Takimoto | 292/216 |
| 5,639,130 | A | | 6/1997 | Rogers, Jr. et al. | |
| 5,758,912 | A | * | 6/1998 | Hamada | 292/216 |
| 5,780,792 | A | | 7/1998 | Fritts et al. | |
| 5,810,403 | A | | 9/1998 | Prada | |
| 5,823,017 | A | | 10/1998 | Hapke et al. | |
| 5,879,036 | A | | 3/1999 | Moline et al. | |
| 6,036,241 | A | | 3/2000 | Ostdiek et al. | |
| 6,164,711 | A | * | 12/2000 | Neal et al. | 296/37.12 |
| 6,290,270 | B1 | * | 9/2001 | Spiessl | 292/226 |

* cited by examiner

*Primary Examiner*—Kathy Matecki
*Assistant Examiner*—Carlos Lugo
(74) *Attorney, Agent, or Firm*—Diederiks & Whitelaw, PLC

(57) ABSTRACT

A mechanism for use in latching a pivotable access door of a cabinet includes a latch housing within which is rotatably mounted a catch member between latching and unlatching positions upon a carrier which, in turn, is rotatably supported in the latch housing. The carrier is biased into engagement with a cam pin which acts as a pivot stop for the carrier. A cross pin extends through a pair of laterally spaced slots formed in the latch housing and terminal ends of the cross pin are adapted to depress electronic switches through movement of the carrier when the latching mechanism assumes the latched position. The catch member is rotated to the latching position upon engagement with a latch striker and can be rotated to release the latch striker, in accordance with various embodiments of the invention, either through the use of a handle or upon tugging on the access door.

36 Claims, 10 Drawing Sheets

LATCHING MECHANISM FOR AN APPLIANCE DOOR

BACKGROUND OF THE INVENTION

1. Field of the Invention

The present invention pertains to the art of appliances and, more particularly, to a latching mechanism for the door of an appliance.

2. Discussion of the Prior Art

The desire to latch an access door of an appliance in a closed position for various reasons is recognized in the art. Particularly, it is often desired to assure the positive latching of an appliance door during certain operating modes for safety reasons, as well as to enable the appliance to operate properly. For instance, the need for an access door latching arrangement is particularly realized in dishwashing machines. That is, as the machine proceeds through a washing operation, there is a need to maintain a proper seal about the periphery of the access door in order to assure that water, which is sprayed throughout the interior of the dishwasher in various stages of an overall washing operation, does not leak about the access door. Therefore, although a sealing gasket may be provided about the access door, it is necessary to maintain the door in a proper position and to latch the door to maintain the desired sealing.

Of course, the need to incorporate a latching mechanism in an appliance adds to the associated manufacturing costs. In addition, the latching mechanism can introduce certain design constraints and considerations. For example, given the life expectancy of a typical household appliance, the latching mechanism must be effectively designed for reliable operation over a prolonged period of time. Therefore, the mechanism must accommodate manufacturing tolerances and possible relative shifting between the access door and the remainder of the appliance over its useful life in order to avoid the need for independent adjusting of the latching mechanism for proper operation.

In latching mechanisms for certain appliances, it has heretofore been proposed to electrically signal when a latched condition has been reached, with the signal being received by a control unit which regulates other stages of operation for the appliance. For example, as indicated above, it would not be desirable to initiate a dishwashing operation until it was assured that the access door for the dishwasher was fully latched. However, when utilizing an electrical switch in connection with the latching mechanism for an appliance, there can arise certain timing considerations. That is, it would be beneficial to assure that an appropriate electrical signal is forwarded to the controls for the dishwasher upon an initial stage of unlatching of the appliance door rather than simultaneously with the reaching of an unlatched condition. In any event, although various latching mechanisms for dishwashers and other appliances have already been proposed in the art, in general, these known arrangements are considered to have certain shortcomings such that a need exists in the art for an improved mechanism for reliably latching the access door of an appliance, as well as providing for an improved timing arrangement when electrically signaling the latching status of the mechanism to a control unit of the appliance.

SUMMARY OF THE INVENTION

The present invention is directed to a mechanism particularly adapted for use in latching a pivotal access door of an appliance in a closed position during predetermined modes of operation of the appliance. The latching mechanism incorporates structure for releasably retaining the door in a closed position, as well as additional structure for electrically signaling the latching state of the mechanism to a control unit of the appliance in a timed manner.

In accordance with a preferred embodiment of the invention, the latching mechanism includes a latch housing within which is rotatably mounted a catch member. The catch member is actually rotatably supported between latching and unlatching positions upon a latch bracket or carrier which, in turn, is pivotably supported in the latch housing. The carrier is biased, preferably by a pair of laterally spaced springs, into engagement with a cam pin or rod which acts as a pivot stop for the carrier. In accordance with a first embodiment of the invention, a cross pin is connected to the carrier and rotatably supports a latch handle having one end portion which is adapted to engage the carrier for rotating the same against the biasing force of the springs. The cross pin actually extends through a pair of laterally spaced slots formed in the latch housing such that terminal ends of the cross pin are exposed. Electronic switches are arranged adjacent the terminal ends of the cross pin and are adapted to be depressed when the latching mechanism assumes a latched condition. A spring is also provided to bias the handle towards a non-engagement position with the carrier.

The catch member itself is formed with a camming surface defining at least first and second radially spaced detent positions adapted to be engaged by the cam pin depending upon whether the latching mechanism is in a latched or unlatched state. More specifically, when the overall latching mechanism is in an unlatched state, the catch member is located in a position wherein the carrier is depressed and the cam pin is received in the first detent in order to maintain the catch member in a desired receiving position for a latch striker. That is, the catch member includes first and second spaced arms that define a receiving area therebetween which is aligned with an opening provided in a rear portion of the latch housing for receiving the latch striker. In this unlatched condition, the carrier is spring loaded and the cross pin is shifted to a position wherein the electric switches are not engaged. When the latch striker enters between the arms of the catch member, the catch member is forced to rotate which causes the cam pin to come out of engagement with the first detent, ride along the camming surface and become positioned at the second, latching detent. In the latching position, the carrier is shifted relative to the housing and, in turn, the cross pin is shifted within the receiving slots of the housing to engage the electrical switches. With the switches engaged, a signal is provided to verify that the mechanism is properly latched.

In a second preferred embodiment of the invention, the latch handle is replaced by a shortened handle which, instead of pivoting about an axis defined by the cross pin, it is rotatably supported directly by the latch housing. In this embodiment, the handle is provided with two projecting prongs which directly abut the carrier for pivoting of the carrier and shifting of the cross pin against the biasing force of the latch springs. This second embodiment also has a modified form wherein the handle is completely removed. In this modified form, the latching mechanism is shifted from an unlatched condition to a latched condition by simply pushing on the appliance door such that the latch striker causes the catch member to automatically rotate. In order to unlatch the overall assembly, the appliance door is pulled by a force which causes the carrier to deflect against the biasing force of the springs, with a corresponding rotation of the catch member. In each of the embodiments, the carrier is rotated about an axis defined by a reinforcing rib of the housing to cause the cross pin to activate the electronic switches. Mounting the cross pin in slots enables an appropriate timing between the signals sent from the switches to a control unit of the appliance and the actual latching state change of the overall mechanism.

Additional objects, features and advantages of the present invention will become more readily apparent from the following detailed description of the preferred embodiments thereof, when taken in conjunction with the drawings wherein like reference numerals refer to corresponding parts in the several views.

DETAILED DESCRIPTION OF THE PREFERRED EMBODIMENTS

Figure 1:
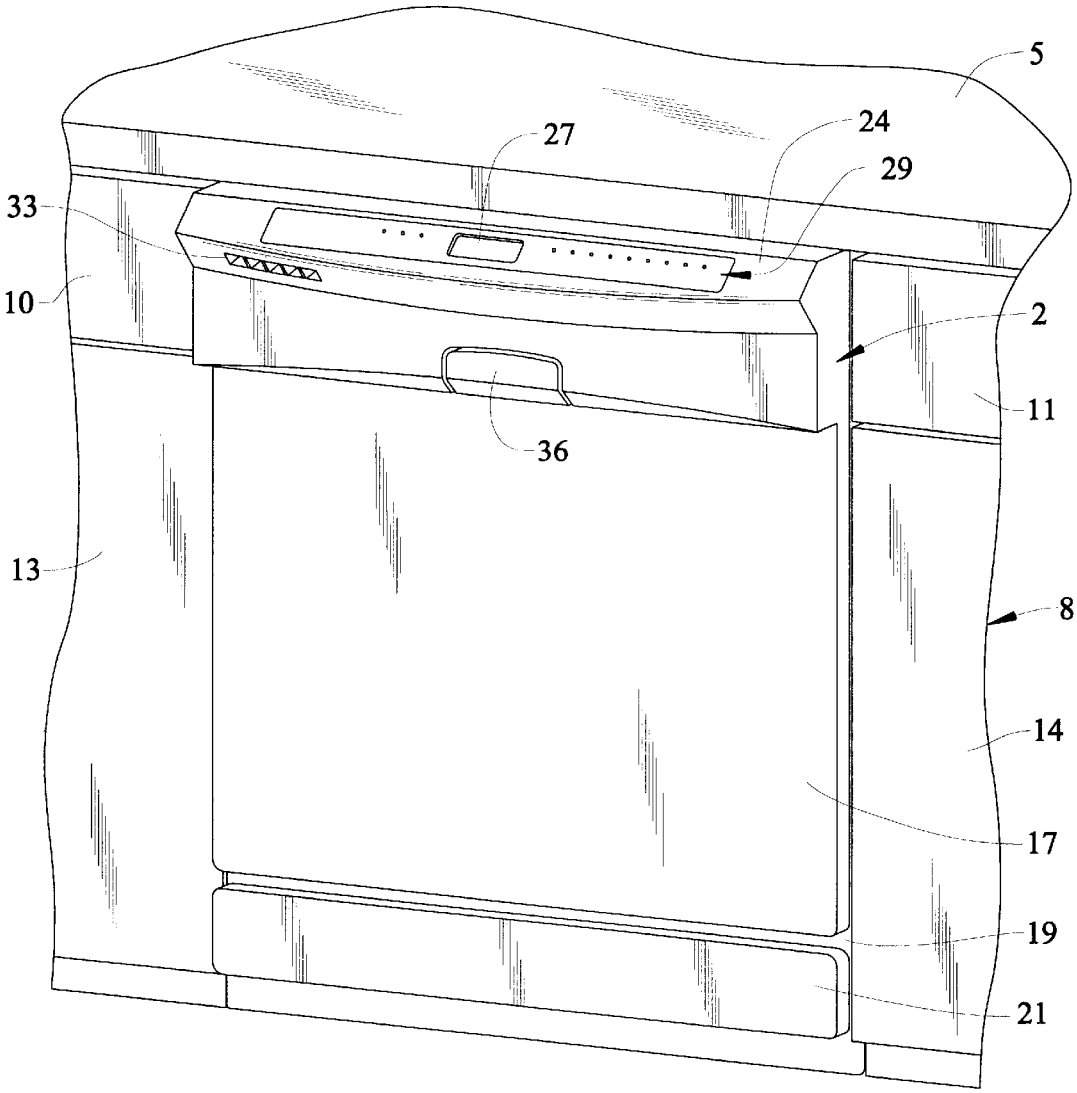
FIG. 1 is a front perspective view of a dishwashing machine incorporating the latching mechanism of the present invention.
Figure 2:
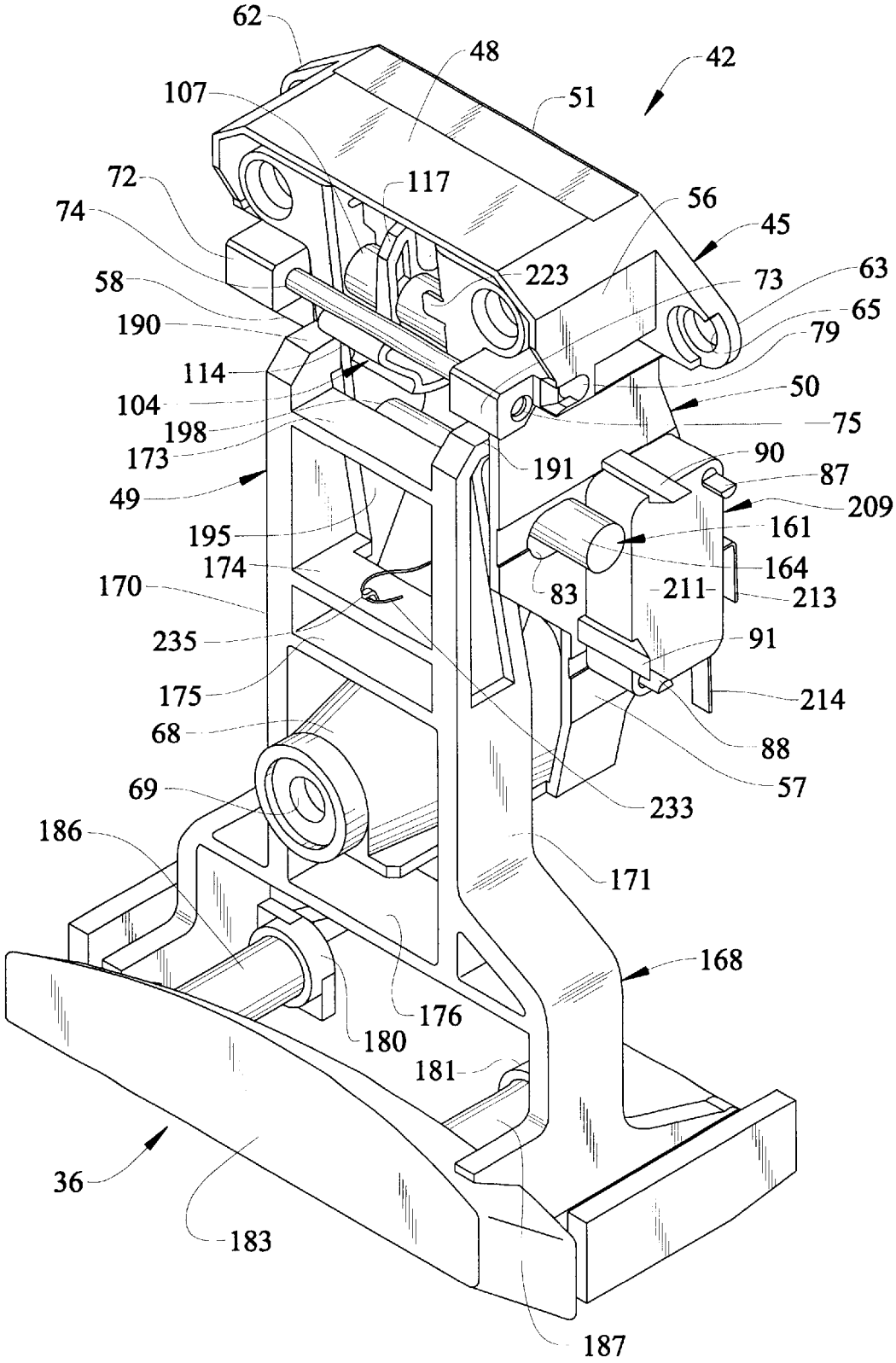
FIG. 2 is a perspective view of the latching mechanism of the present invention constructed in accordance with a first preferred embodiment.

With initial reference to FIG. 1, a dishwasher 2 is generally indicated to be positioned below a kitchen countertop 5. Also below countertop 5 is shown cabinetry 8 including a pair of drawers 10 and 11 and lower cabinet doors 13 and 14. Dishwasher 2 includes a door 17 that is pivotally mounted to a cabinet shell 19. Dishwasher 2 is also shown to include an access panel 21 and a control panel portion 24. Control panel portion 24 includes a display 27, a row of control buttons 29 and a vent zone 33. In general, this overall arrangement of dishwasher 2 and countertop 5 is known in the art wherein dishwasher door 17 is adapted to extend across and close an access opening associated with cabinet shell 19, while also being pivotable, such as through handle 36, to a position which enables loading and unloading of dishwasher 2. Since this general construction and operation of dishwasher 2 is widely known in the art, it will not be discussed further here in detail. Instead, the present invention is particularly directed to a latching mechanism for dishwasher door 17, a first preferred embodiment thereof being illustrated in FIGS. 2–6.

As shown in the embodiment of FIGS. 2–7, a latching mechanism 42 includes a latch housing 45 that is preferably, integrally molded of plastic. Latch housing 45 includes an upper panel 48, side panels 49 and 50, a back panel 51 and a generally central, upstanding cross rib 52 extending between side panels 49 and 50. Each side panel 49, 50 includes an upper section 56 and a lower section 57 which are interconnected by a respective laterally extending section 58. Extending laterally outwardly from upper section 56, adjacent back panel 51, is a pair of flanges 62 and 63, each of which includes a respective aperture 65. At lower section 57 is formed an upstanding mounting projection 68 which is also provided with an aperture 69. Flanges 62 and 63, along with upstanding mounting projection 68, are adapted to receive mechanical fasteners, such as screws, for mounting latch housing 45 within dishwasher door 17.

Along laterally extending sections 58 of side panels 49 and 50 are formed a pair of laterally spaced mounting bosses 72 and 73. Bosses 72 and 73 have respective, aligned bores 74 and 75 that define an axis which extends laterally across housing 45. Generally adjacent mounting bosses 72 and 73, latch housing 45 is preferably formed with recessed areas 78 and 79 for reasons which will become more fully evident below. In addition, latch housing 45 is preferably formed with a pair of slots 82 and 83, each in a respective lower section 57 of side panels 49 and 50. Also formed at lower section 57 of each side panel 49 and 50 are a pair of laterally outwardly projecting posts 87 and 88, as well as clip members 90 and 91. In back panel 51 of latch housing 45, preferably slightly below upper panel 48, is formed a receiving slot 94 which, in the most preferred form of the invention, has its entire periphery beveled or tapered at back panel 51 as indicated at 96 (see, particularly, FIG. 7).

Latching mechanism 42 further incorporates a catch member or cam 104 including a sleeve 107 from which projects an arcuate extension 110 that defines a camming surface 112. Along camming surface 112 is defined first and second detents 114 and 115. Catch member 104 also has projecting from sleeve 107, generally opposite arcuate extension 110, a pair of spaced arms 117 and 118. Within sleeve 107 is provided an internal spring 120 having terminal legs 122 and 123 (see FIG. 3). As will be detailed more fully below, spring 120 biases catch member 104 into a receiving position.

Latching mechanism 42 also includes a carrier or latch bracket 128 that is preferably formed of metal. As shown, carrier 128 is generally in the form of an inverted U and includes elongated side portions 131 and 132, each of which is preferably, generally L-shaped in cross-section so as to include a frontal extension 134 and a side extension 135. Carrier 128 also includes an upper cross piece 137, as well as a reinforcing second cross piece 138. Adjacent upper panel 48, carrier 128 includes a pair of tabs 140, 141 which project from frontal extension 134 of each side portion 131 and 132. Tabs 140 and 141 are provided with respective through holes 144 and 145. On the other hand, each side extension 135 is formed with a respective cross hole 148 and 149 which are aligned along a laterally extending axis. As will be detailed more fully below, tabs 140 and 141 are adapted to be biased by means of respective springs 153 away from back panel 51 of latch housing 45.

As shown in these figures, catch member 104 is rotatably mounted between side extensions 135 of elongated side portions 131 and 132 of carrier 128, with carrier 128 and catch member 104 being positioned within latch housing 45. More specifically, tabs 140 and 141 are arranged at upper section 56 of side panels 49 and 50 respectively, while side portions 131 and 132 of carrier 128 project along lower sections 57 of side panels 49 and 50. Each spring 153 abuts both back panel 51 and a respective tab 140 and 141. Latching mechanism 42 further includes a cam pin or rod 157 which extends through aligned bores 74 and 75 of mounting bosses 72 and 73, as well as a carrier or cross pin 161 which extends through each of slots 82 and 83, as well as cross holes 148 and 149. In this manner, carrier 128 is interconnected to latch housing 45 through cross pin 161, with upstanding rib 52 of latch housing 45 acting as a fulcrum upon which cross piece 138 of carrier 128 is positioned. On the other hand, catch member 104 shifts in unison with carrier 128 about cross pin 161 while also being rotatable relative to carrier 128 by means of a pin 162 (see FIG. 4) which extends through sleeve 107 and the side extension 135 of each side portion 131 and 132. As shown, cross pin 161 preferably has terminal end portions 163 and 164 which project laterally outwardly of side panels 49 and 50 for the reasons which will be more fully discussed below. In addition, cross pin 161 preferably includes a reduced diametric portion 165 that is shown to be centered along the length of cross pin 161. In the most preferred form, both cam pin 157 and cross pin 161 are formed of metal.

In accordance with this embodiment, handle 36 includes a body portion 168 that is preferably integrally molded of plastic. Body portion 168 includes side portions 170 and 171, as well as various reinforcing cross ribs 173-176. Body portion 168 is also formed with a pair of grip receiving mounts 180 and 181. Handle 36 also includes a grip 183 that is preferably formed separate from body portion 168 and includes posts 186 and 187 which are received within mounts 180 and 181 and secured therein, preferably by the use of threaded fasteners (not shown). Side portions 170 and 171 of handle 36 are preferably formed with curved upper ends 190 and 191 which are adapted to abut the frontal extension 134 of side portions 131 and 132 of carrier 128 during an unlatching sequence, as will be described more fully below. Body portion 168 is also formed with a pair of pivot extensions 195 and 196 which have respective aligned bores 198 through which cross pin 161 extends. Therefore, both carrier 128 and handle 36 are attached to latch housing 45 through cross pin 161. Finally, handle 36 is shown to include a guide projection 201 (see FIG. 3) which has an end terminating within reduced diametric portion 165 of cross pin 161.

The overall latching mechanism 42 also preferably includes a pair of electrical switches 208 and 209. Each electrical switch 208, 209 includes a body 211, a pair of electrical connectors 213, 214 and an activation member 216 (see FIG. 6). In general, when activation member 216 is depressed, connectors 213 and 214 are electrically interconnected. The body 211 of each switch 208 and 209 is provided with a pair of bores 219 and 220.

Figure 3:
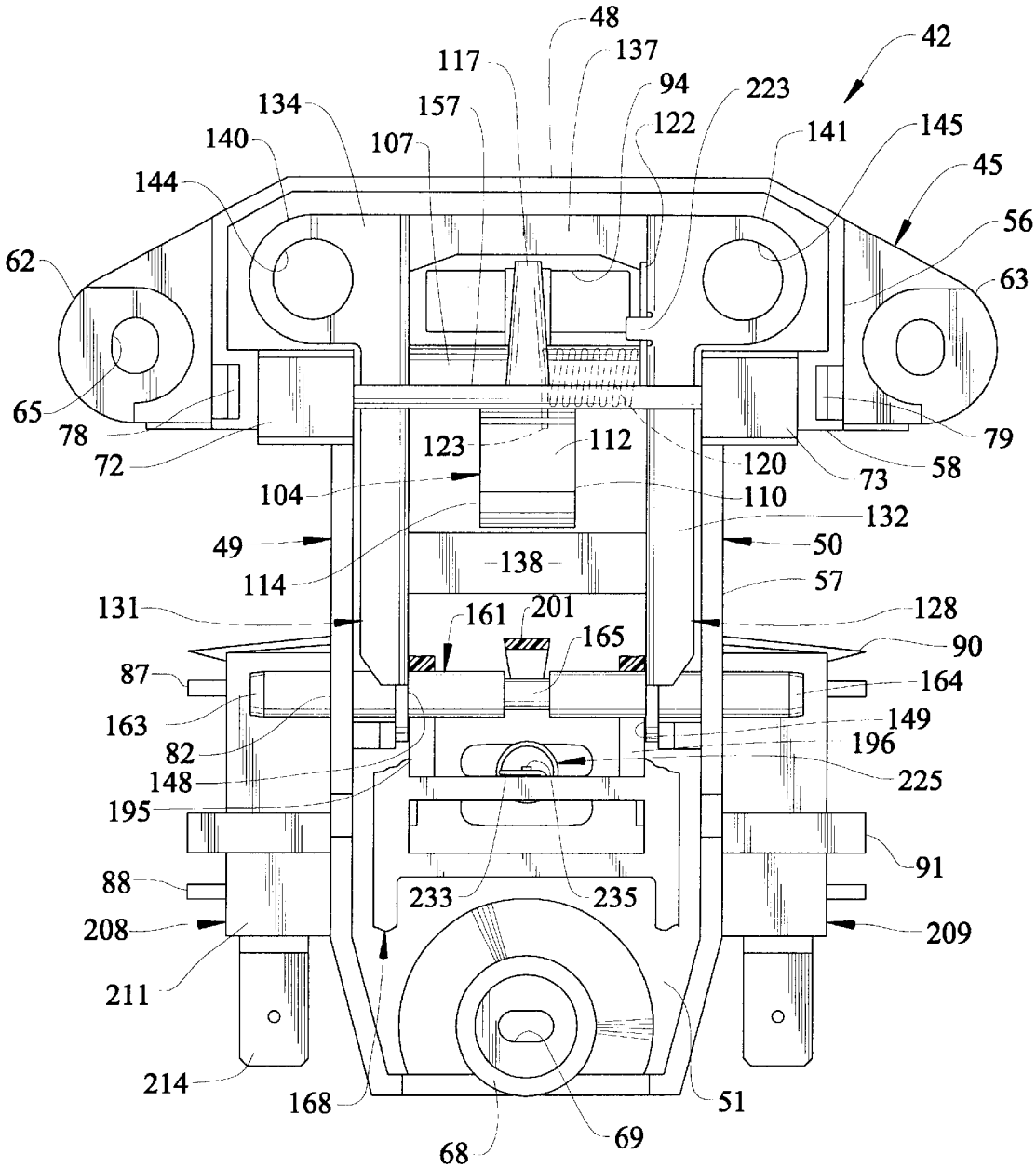
FIG. 3 is a front plan view of the latching mechanism of FIG. 2, with portions of the handle removed for clarity purposes.
Figure 4:
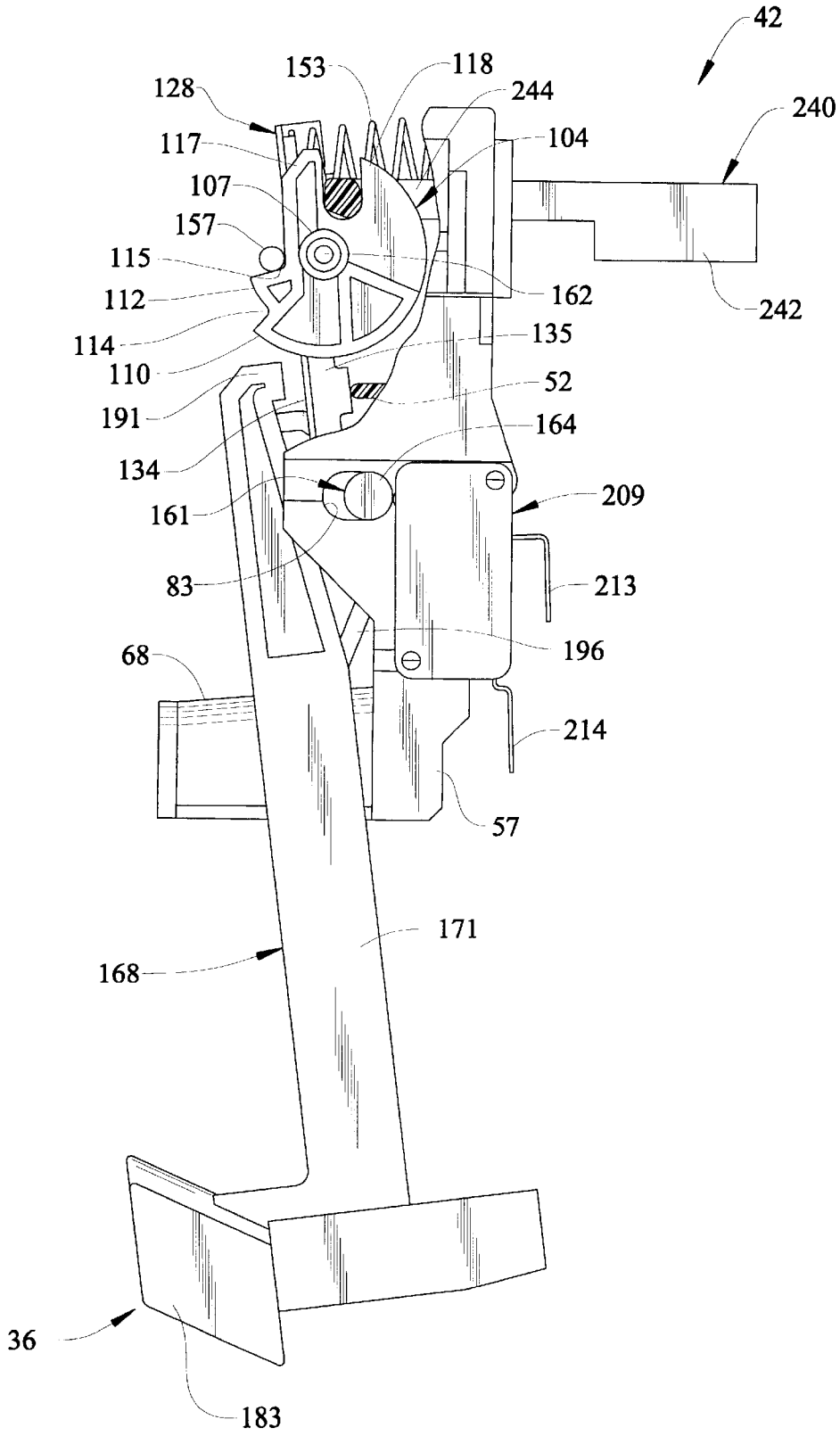
FIG. 4 is a side view of the latching mechanism of FIG. 2 in a latched state.
Figure 6:
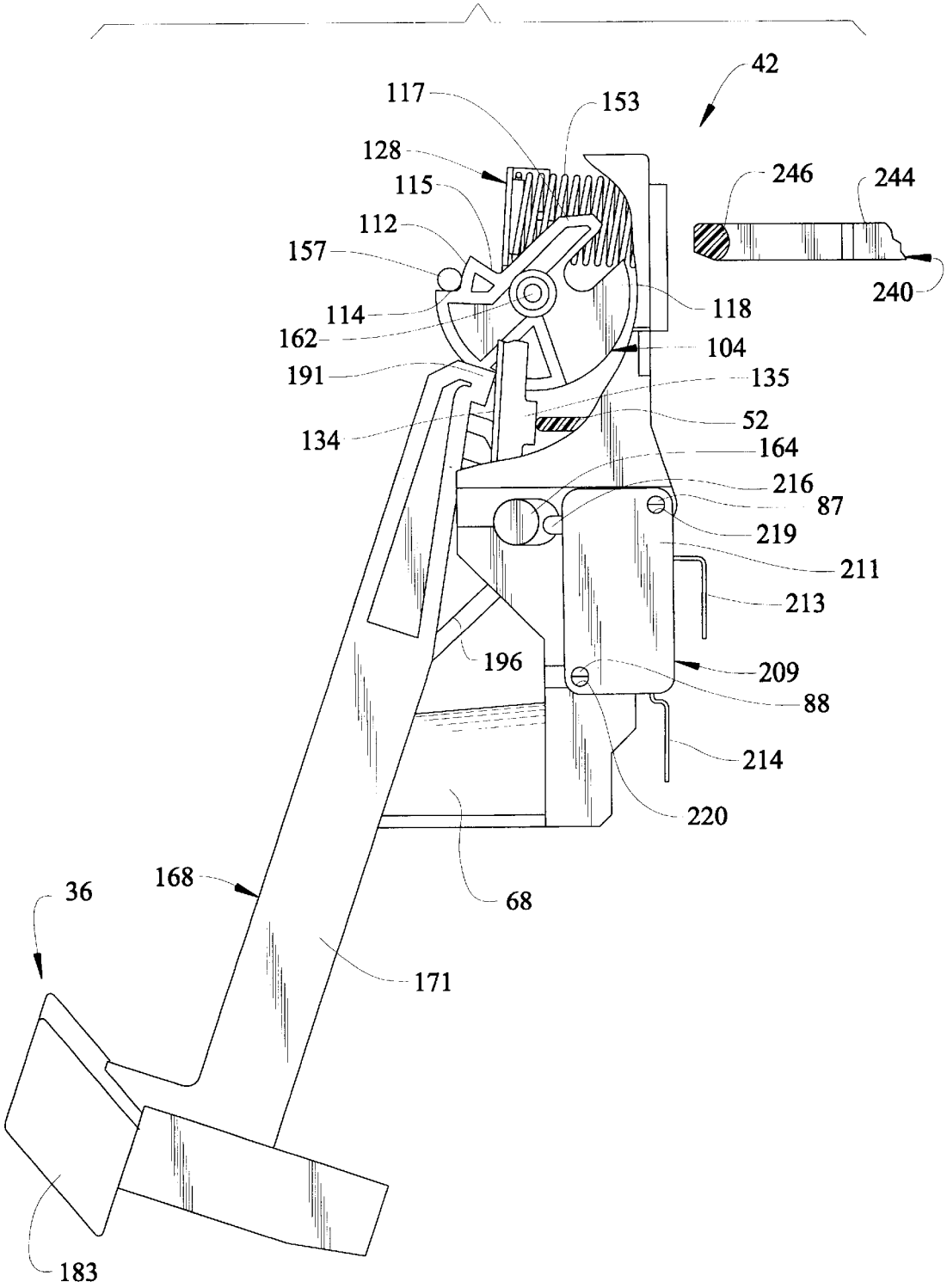
FIG. 6 is a side view, similar to FIGS. 4 and 5, depicting the latching mechanism in an unlatched condition.
Figure 7:
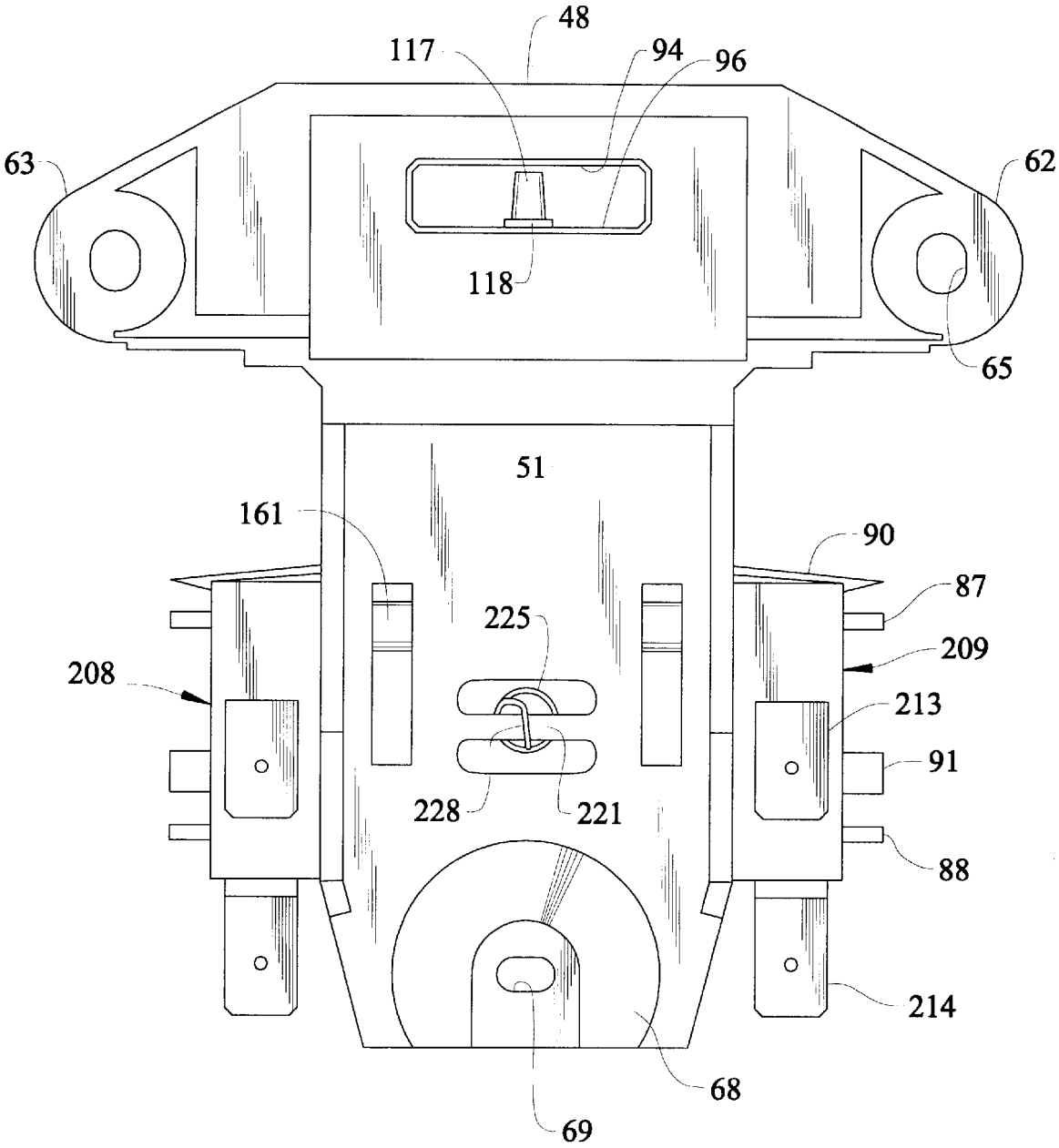
FIG. 7 is a rear plan view of the latching mechanism of FIGS. 2–6.

As indicated above, catch member 104 is biased by spring 120 to an unlatched or receiving position as best shown in FIG. 6. In the most preferred embodiment, side portion 131 of carrier 128 has lanced out a tab 223 against which leg 122 of spring 120 abuts. The second leg 123 of spring 120 terminates within catch member 104 as shown in FIG. 3. In any event, spring 120 biases catch member 104 from the position shown in FIG. 4 towards the position shown in FIG. 6. As also indicated above, catch member 104 is shifted in unison with the pivoting or rocking of carrier 128 upon upstanding rib 52, while handle 36 pivots about cross pin 161. A spring 225 has a first end 228 which is attached to a cross support 221 formed as part of back panel 51 and a second end 233 which is looped about a protrusion 235 formed as part of body portion 168. Therefore, spring 225 biases handle 36 to a non-use position as best shown in FIG. 4. In this position, the curved upper ends 190 and 191 of body portion 168 are spaced from elongated side portions 131 and 132 of carrier 128.

FIGS. 2–5 depict latching mechanism 42 in a latched condition. That is, a latch striker 240, which includes a mounting portion 242, adapted to be attached to cabinet shell 19, and a latch portion 244 provided with an opening 246, is used in combination with the other components of latching mechanism 42 carried by latch housing 45 to selectively latch dishwasher door 17 across the frontal opening of cabinet shell 19. More specifically, when latching mechanism 42 is in a latched condition, latching portion 244 of latch striker 240 extends through receiving slot 94 formed in back panel 51 and between arms 117 and 118 of catch member 104. Closing of dishwasher door 17 will force catch member 104 to rotate relative to carrier member 128 by direct abutment of latching portion 244 with arm 117. Catch member 104 will rotate about pin 162, with cam pin 157 riding along camming surface 112 until cam pin 157 reaches second detent 115. Given that detent 115 is radially spaced from camming surface 112, springs 153 will force, indirectly through carrier 128, catch member 104 to shift away from back panel 51. The rotation of catch member 104 tends to load internal spring 120 which, as indicated above, biases catch member 104 to the position shown in FIG. 6. When springs 153 shift carrier 128, side portions 131 and 132 of carrier 128 abut cam pin 157 which, in turn, forces cross pin 161 to be shifted within slots 82 and 83. Arranged directly at the lower ends of slots 82 and 83 are the activation members 216 of the electrical switches 208 and 209 which, in turn, are mounted with posts 87 and 88 extending through bores 219 and 220 and clips 90 and 91 projecting around respective portions of body 211 as clearly shown in these Figures. Therefore, in this latched condition, terminal end portions 163 and 164 of cross pin 161 are forced into abutment with the activation members 216 of electrical switches 208 and 209 respectively in order to electrically link connectors 213 and 214. Electrical switches 208 and 209 are wired to a controller (not shown) in panel 24 and function to send signals regarding the latching state of mechanism 42. Since latch striker 240 is retained by catch member 104 prior to the shifting of cross pin 161, there is an inherent time delay in the signaling of the latching state. The significance of this time delay will be discussed further herein.

Figure 5:
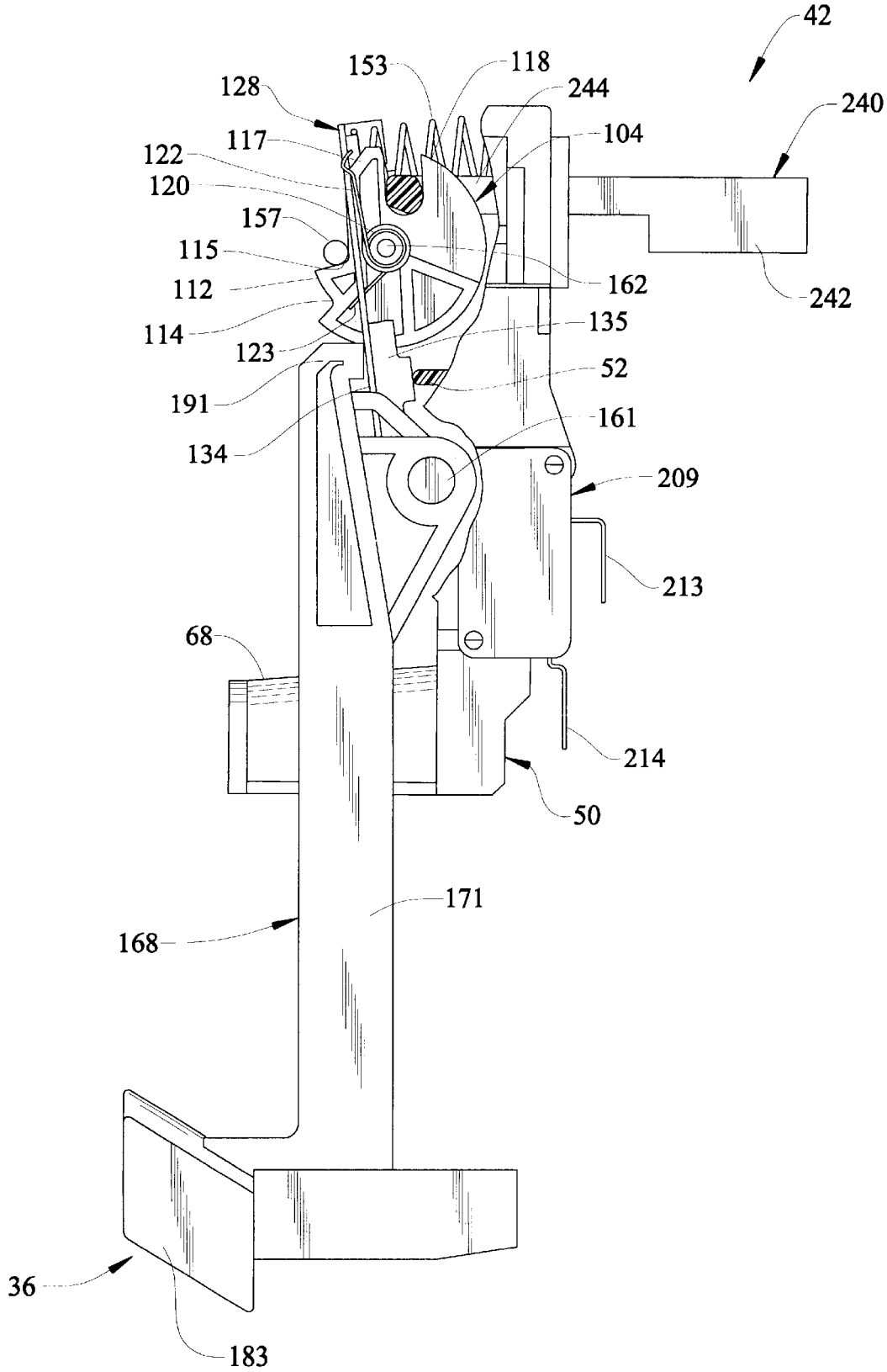
FIG. 5 is a side view, similar to that of FIG. 4, with the handle of the latching mechanism being shifted to an initial state during an unlatching operation.

When it is desired to unlatch mechanism 42, handle 36 is initially shifted from the position shown in FIG. 4 to the position shown in FIG. 5 about the pivot axis defined by cross pin 161. In the FIG. 5 position, curved upper ends 190 and 191 are initially brought into abutment with elongated side portions 131 and 132 of carrier 128. Upon further lifting of handle 36 at grip 183, handle 36 will tend to cause carrier 128 to pivot or rock upon upstanding rib 52 such that cross pin 161 will be initially shifted within slots 82 and 83 relative to latch housing 45. As cross pin 161 is shifted within slots 82 and 83, cross pin 161 will be caused to become disengaged from the activation members 216 of electrical switches 208 and 209. Thereafter, cross pin 161 will reach the ends of slots 82 and 83 and abut portions of side panels 49 and 50. Thereafter, the further pulling of grip 183 will cause handle 36 to pivot about cross pin 161 to cause upper ends 190 and 191 to push upon side portions 131 and 132 of carrier 128. Carrier 128 will be forced to pivot upon upstanding rib 52, initially disengaging elongated side portions 131 and 132 from cam pin 157 and also causing catch member 104 to shift towards back panel 51 relative to cam pin 157.

Once cam pin 157 reaches the height of camming surface 112, catch member 104 will automatically rotate due to the biasing of spring 120 until cam pin 157 becomes positioned in the first detent 114 as shown in FIG. 6. In this position, latch striker 240 is released from between arms 117 and 118 of catch member 104 such that dishwasher door 17 is free to pivot relative to cabinet shell 19. Although springs 153 tend to bias carrier 128 to the position shown in FIGS. 2–5, carrier 128 is prevented from pivoting and cross pin 161 is maintained spaced from activation members 216 of electrical switches 208 and 209 due to the presence of upstanding rib 52 and the arrangement of cam pin 157 in first detent 114. Therefore, without the rotation of catch member 104, latching mechanism 42 will remain in the unlatched state of FIG. 6, although handle 36 would actually, automatically shift to the position shown in FIG. 4 due to the biasing force created by spring 225.

As with the latching sequence, the unlatching of mechanism 42 has an associated inherent timing sequence with the signals sent from electrical switches 208 and 209. That is, a latching signal from switches 208 and 209 is terminated by the shifting of cross pin 161 away from activation members 216 during an initial unlatching stage. When latching mechanism 42 is incorporated in an appliance such as dishwasher 2, this timing sequence is considered to be important since, if a consumer attempts to open dishwasher door 17 during a wash cycle, the controls for dishwasher 2 will receive an early indication and will have ample time to terminate the operation of any sprayers, motors, pumps and the like. In addition, when shifting between the unlatched and latched positions, dishwasher door 17 becomes fully latched prior to the closure of switches 208 and 209 such that this configuration also provides an advantageous time delay. It should also be noted that tapered or beveled periphery 96 of slot 94 advantageously functions to align latch striker 240 and receiving slot 94 even given possible relative shifting between door 17 and cabinet shell 19 due to manufacturing tolerances, as well as over the useful life of dishwasher 2.

Figure 8:
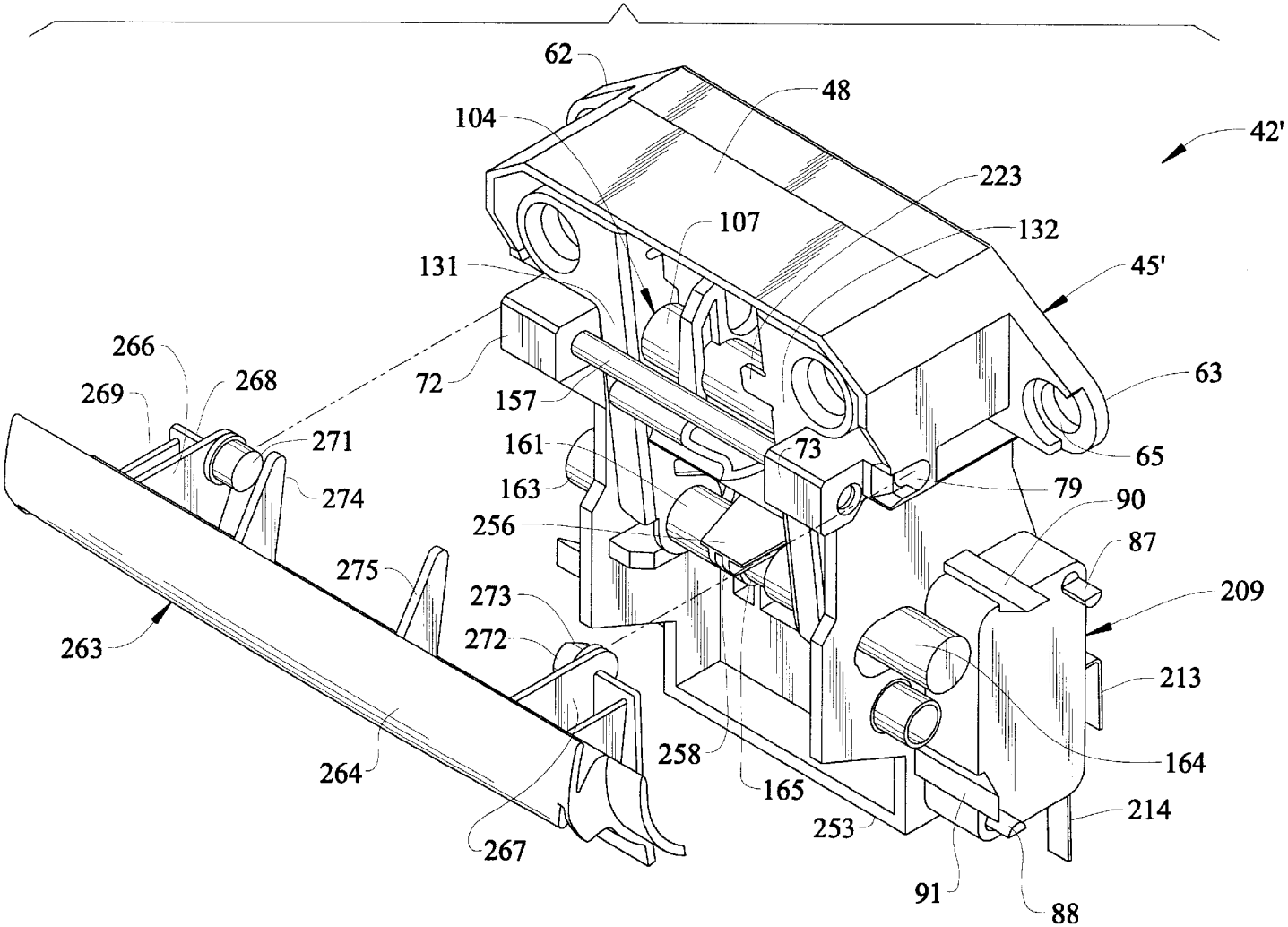
FIG. 8 is an exploded, perspective view of a second embodiment of the latching mechanism of the present invention.
Figure 9:
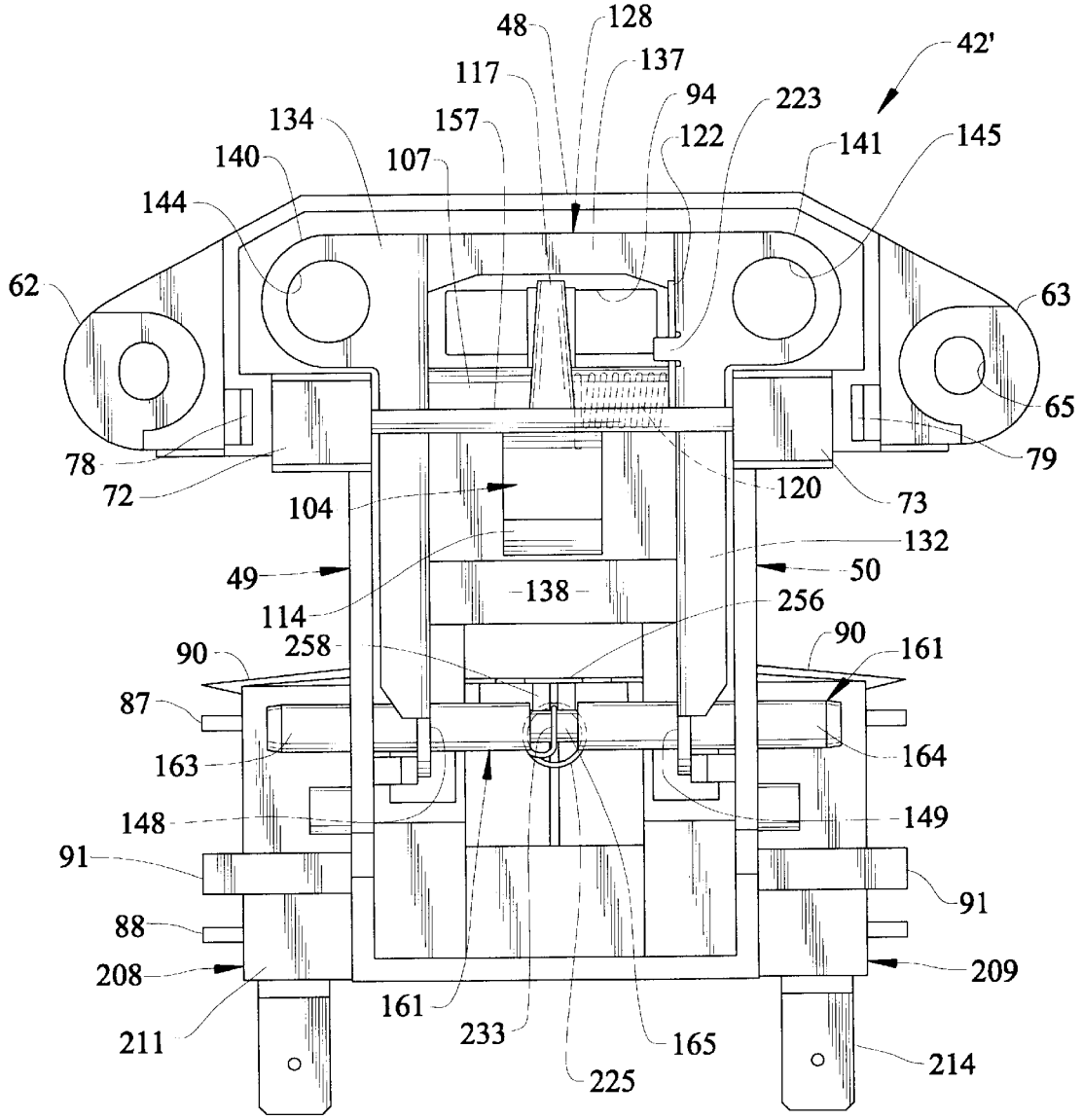
FIG. 9 is a front view of the latching mechanism of FIG. 8 without the handle of FIG. 8.
Figure 10:
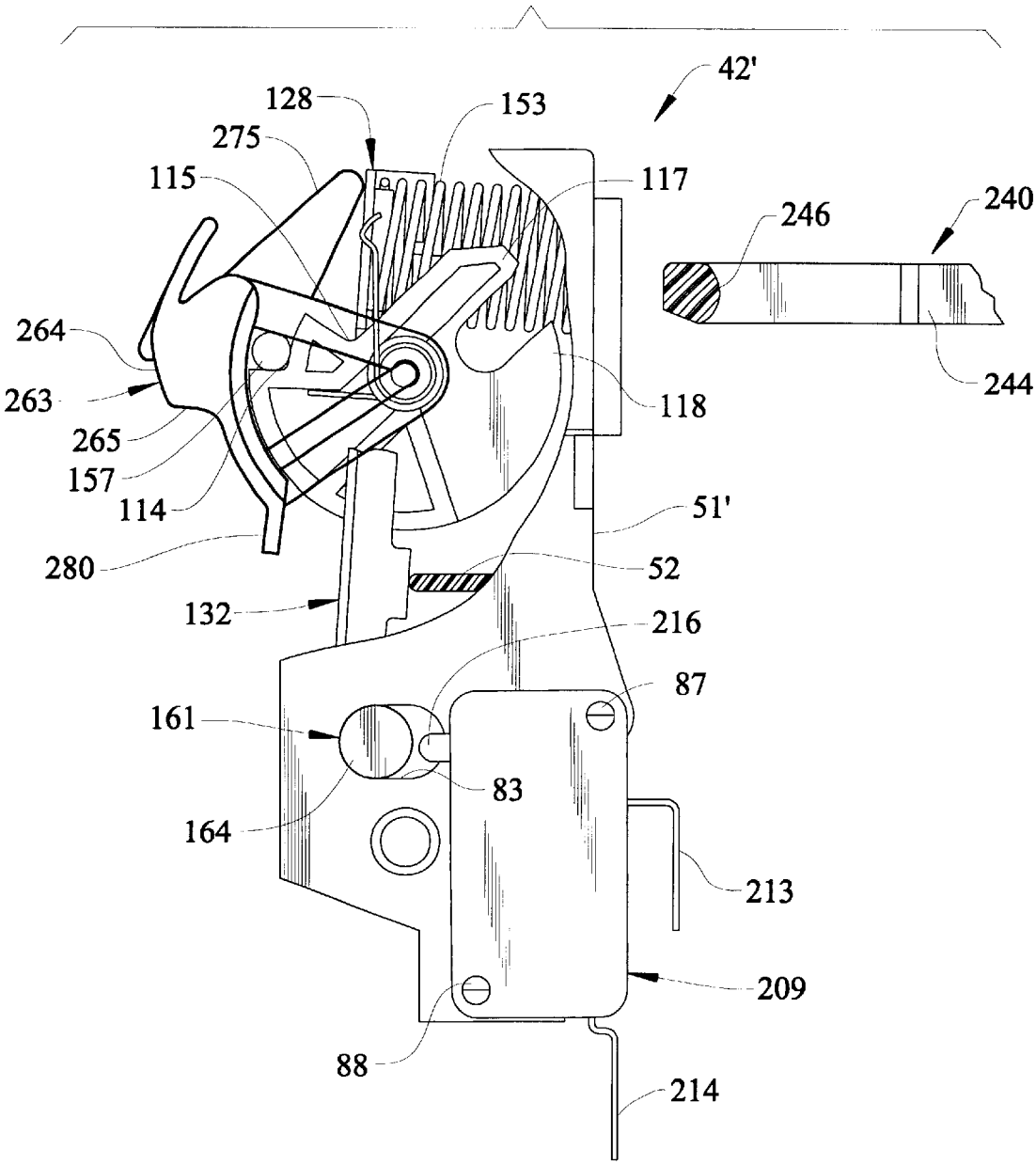
FIG. 10 is a side view of the latching mechanism according to the second embodiment of the invention in an unlatched condition.

Reference will now be made to FIGS. 8–10 in describing additional preferred embodiments of the present invention. In general, the latching mechanisms of these embodiments function in a manner substantially identical to that described above with respect to the embodiment of FIGS. 2–7. Therefore, emphasis will be placed here on the differences between these embodiments and it is to be understood that like reference numerals refer to corresponding components between the various embodiments, with these components performing the functions described above unless otherwise detailed below.

In general, the latching mechanism 42' of FIGS. 8–10 is more compact than the latching mechanism of FIGS. 2–7. Latching mechanism 42' includes a latch housing 45' which is shortened as compared to latch housing 45 and does not include a corresponding upstanding mounting projection 68, but rather simply has a lower end wall 253. As also clearly shown in these Figures, the elongated handle 36 and its corresponding guide projection 201 is not present. To perform corresponding functions, latch housing 45' includes a center extension 256 which projects from back panel 51'. Center extension 256 preferably includes a bifrucated end 258 which is positioned within reduced diametric portion 165 of cross pin 161 and which receives second end 233 of spring 225 which extends around cross pin 161. Therefore, in this embodiment, spring 225 biases cross pin 161 towards the activation members 216 for electrical connectors 213 and 214. It should be noted that the construction, interconnection and function of catch member 104, carrier 128, latch springs 153, cam pin 157, cross pin 161 and electrical switches 208 and 209 are the same as that of the first embodiment described above.

The latching mechanism 42' of FIGS. 8–10 can be used with or without a handle 263. As shown, handle 263 includes a face portion 264 having an associated undercut 265 for use in gripping handle 263. Handle 263 also includes a first pair of laterally spaced extensions 266 and 267, each of which is supported by perpendicular reinforcing ribs 268 and 269. Each laterally spaced extension 266, 267 has associated therewith a respective, laterally inwardly extending stub shaft 271, 272, at least one of which preferably has a tapered end portion 273. Furthermore, handle 263 has associated therewith a pair of projections or prongs 274 and 275, with this structure being clearly shown in FIGS. 8 and 10.

With this arrangement, stub shafts 271 and 272 are adapted to be positioned within recessed areas 78 and 79 respectively. With at least one of stub shafts 271 and 272, including the tapered end portion 273, the initial positioning of one stub shaft 271, 272 in a respective recessed area 78, 79 will enable the other stub shaft 272, 271 to be snap-fit into its respective recessed area 79, 78 with the aid of the tapered end portion 273. In any event, handle 263 will be able to pivot about an axis defined by stub shafts 271 and 272. When latching mechanism 42' is in an unlatched state, projections 274 and 275 are spaced from elongated side portions 131 and 132 of carrier 128. However, after latch striker 240 is received between arms 117 and 118 to cause rotation of catch member 104 upon closing of dishwasher door 17, the subsequent pivoting of carrier 128 and the shifting of cross pin 161 in slots 82 and 83, projections 274 and 275 preferably abut side portions 131 and 132. That is, in the arrangement shown in FIG. 10, handle 263 is free to pivot from the position shown, wherein projections 274 and 275 abut carrier 128, counterclatchwise until a rear portion 280 of handle 263 abuts latch housing 45'. However, when latching mechanism 42' is latched, projections 274 and 275 directly abut carrier 128. In any event, when in this latched condition, the lifting of handle 263 causes handle 263 to pivot about the axis defined by stub shafts 271 and 272 whereupon projections 274 and 275 directly deflect carrier 128 thereby causing the shifting of cross pin 161 away from electrical connectors 213 and 214 and, subsequently, the rotation of catch member 104 through the biasing of spring 120 and the release of latch striker 240.

At this point, it should be noted that FIGS. 8–10 can actually represent another embodiment of the invention wherein no handle at all is utilized. That is, handle 263 is not a required component. Instead, latching mechanism 42' can assume a latching position upon closing of dishwasher door 17 with latching portion 244 of latch striker 240 causing the rotation of catch member 104 and the shifting of carrier 128, as well as cross pin 161. The unlatched state would require a tug on dishwasher door 17 whereupon latch striker 240 would be drawn from rear receiving slot 94 while acting on arm 118 of catch member 104 to cause catch member 104 to both deflect away from cam pin 157 and rotate relative to carrier 128 until cam pin 157 was received in second detent 115. In fact, the first embodiment of FIGS. 2–6 could also operate in a corresponding manner if desired.

Based on the above, it should be recognized that the various components of the latching mechanism 42, 42' of the present invention are interconnected in such a manner so as to produce synergistic results, including the timing of electrical signals to a controller for dishwasher 2 concerning the latching status of the overall mechanism 42, 42'. Although described with respect to preferred embodiments of the invention, it should be readily understood that various changes and/or modifications can be made to the invention without departing from the spirit thereof. For example, although the latching mechanism 42, 42' has been disclosed in connection with dishwasher 2, mechanism 42, 42' could be utilized on various types of appliances or even other cabinet structure as well. In any event, the invention is only intended to be limited by the scope of the following claims.

I claim:

1. In a cabinet provided with an access opening and a pivotable door adapted to extend across and close the access opening, a mechanism for latching the pivotable door in a closed position comprising:

a latch housing mounted to one of the door and the cabinet, said latch housing including an opening therein and being provided with a pair of laterally spaced slots wherein the opening in the latch housing includes a beveled portion about a periphery thereof;

a cross pin supported by the latch housing, said cross pin having terminal end portions which project into the slots, wherein an axis defined by the cross pin is movable, within the slots, relative to the latch housing;

a catch member movably mounted relative to the latch housing between latching and receiving positions, said catch member being formed with a camming surface defining at least first and second detent positions, said catch member being shiftable relative to the latch housing upon shifting of the axis defined by the cross pin;

a cam pin extending across a portion of the latch housing, said cam pin being adapted to be received in the first detent position when the latching mechanism assumes an unlatched position and in the second detent position when the latching mechanism assumes a latched position; and a striker element mounted to another of the door and the cabinet, said striker element being adapted to be guided by the beveled portion and project into the opening of the latch housing and abut the catch member to cause shifting of the catch member from the receiving position to the latching position upon closing of the door in order to reposition the cam pin from the first detent position to the second detent position.

2. In a cabinet provided with an access opening and a pivotable door adapted to extend across and close the access opening, a mechanism for latching the pivotable door in a closed position comprising:

a latch housing mounted to one of the door and the cabinet, said latch housing including an opening therein;

a catch member movably mounted relative to the latch housing between latching and receiving positions, said catch member being formed with a camming surface defining at least first and second detent positions;

a cam pin extending across a portion of the latch housing, said cam pin being adapted to be received in the first detent position when the latching mechanism assumes an unlatched position and in the second detent position when the latching mechanism assumes a latched position; and a striker element mounted to another of the door and the cabinet, said striker element being adapted to project into the opening of the latch housing and abut the catch member to cause shifting of the catch member from the receiving position to the latching position upon closing of the door in order to reposition the cam pin from the first detent position to the second detent position.

3. The latching mechanism according to claim 2, wherein the catch member is independently rotatable about a first axis and shiftable relative to the latch housing.

4. The latching mechanism according to claim 3, wherein said catch member is shiftable relative to the latch housing by pivoting about a second axis which is spaced from the first axis.

5. The latching mechanism according to claim 4, further comprising:

a carrier rotatably attached to the latch housing.

6. The latching mechanism according to claim 5, wherein the carrier is shiftable in unison with the catch member relative to the latch housing.

7. The latching mechanism according to claim 6, further comprising:

a cross pin movably supported by the latch housing, said catch member being shiftable relative to the latch housing upon shifting of the cross pin.

8. The latching mechanism according to claim 7, further comprising:

at least one spring, interposed between the latch housing and the carrier, for biasing the latching mechanism to the latched position.

9. The latching mechanism according to claim 7, wherein the latch housing is provided with a pair of spaced slots and the cross pin has terminal end portions which project into the slots, wherein the cross pin is movable relative to the latch housing within the slots.

10. The latching mechanism according to claim 9, further comprising:

at least one switch mounted to the latch housing, said switch including an actuating member adapted to be engaged by the cross pin.

11. The latching mechanism according to claim 9, further comprising:

a handle adapted to abut and pivot the carrier.

12. The latching mechanism according to claim 11, wherein the handle is pivotably mounted about an axis defined by the cross pin.

13. The latching mechanism according to claim 12, wherein, when shifting from the latched position to the unlatched position, movement of the handle initially causes shifting of the cross pin in said slots prior to rotating of the catch member relative to the housing.

14. The latching mechanism according to claim 2, wherein the opening in the latch housing includes a beveled portion about a periphery thereof for guiding the striker element therein.

15. In a cabinet provided with an access opening and a pivotable door adapted to extend across and close the access opening, a mechanism for latching the pivotable door in a closed position comprising:

a latch housing mounted to one of the door and the cabinet, said latch housing including an opening therein and being provided with a pair of laterally spaced slots;

a cross pin supported by the latch housing, said cross pin having terminal end portions which project into the slots, wherein an axis defined by the cross pin is movable, within the slots, relative to the latch housing;

a catch member movably mounted relative to the latch housing between latching and receiving positions, said catch member being shiftable relative to the latch housing upon shifting of the axis defined by the cross pin; and a striker element mounted to another of the door and the cabinet, said striker element being adapted to project into the opening in the latch housing and abut the catch member to cause shifting of the catch member from the receiving position to the latching position upon closing of the door.

16. The latching mechanism according to claim 15, further comprising:

at least one switch mounted to the latch housing, said switch including an actuating member adapted to be engaged by the cross pin.

17. The latching mechanism according to claim 15, further comprising:

a carrier rotatably attached to the latch housing, said catch member being rotatably supported by the carrier, wherein the catch member is shiftable in unison with the carrier relative to the latch housing.

18. The latching mechanism according to claim 17, further comprising:

at least one spring, interposed between the latch housing and the carrier, for biasing the latching mechanism to the latched position.

19. The latching mechanism according to claim 18, further comprising:

a handle adapted to abut and pivot the carrier.

20. The latching mechanism according to claim 19, wherein the handle is pivotably mounted about the axis defined by the cross pin.

21. The latching mechanism according to claim 20, wherein, when shifting from the latched position to the unlatched position, movement of the handle initially causes shifting of the cross pin in said slots prior to rotating of the catch member relative to the housing.

22. The latching mechanism according to claim 15, wherein the opening in the latch housing includes a beveled portion about a periphery thereof for guiding the striker element therein.

23. In a cabinet provided with an access opening and a pivotable door adapted to extend across and close the access opening, a mechanism for latching the pivotable door in a closed position comprising:

a latch housing mounted to one of the door and the cabinet, said latch housing including an opening therein, wherein the opening in the latch housing includes a beveled portion about a periphery thereof;

a catch member movably mounted relative to the latch housing between latching and receiving positions; and a striker element mounted to one of the door and the cabinet, said striker element being guided by the beveled portion into the opening of the latch housing to abut the catch member and cause shifting of the catch member from the receiving position to the latching position upon closing of the door.

24. The latching mechanism according to claim 23, wherein the entire periphery of said opening tapers inwardly.

25. The latching mechanism according to claim 23, further comprising:

a carrier rotatably attached to the latch housing, said catch member being rotatably supported by the carrier, wherein the catch member is shiftable in unison with the carrier relative to the latch housing.

26. The latching mechanism according to claim 25, further comprising:

a cross pin movably supported by the latch housing, said catch member being shiftable relative to the latch housing upon shifting of the cross pin.

27. The latching mechanism according to claim 26, wherein the carrier is shiftable in unison with the catch member relative to the latch housing.

28. The latching mechanism according to claim 26, wherein the latch housing is provided with a pair of spaced slots and the cross pin has terminal end portions which project into the slots, wherein the cross pin is movable relative to the latch housing within the slots.

29. The latching mechanism according to claim 28, further comprising:

at least one switch mounted to the latch housing, said switch including an actuating member adapted to be engaged by the cross pin.

30. The latching mechanism according to claim 28, further comprising:

a handle adapted to abut and pivot the carrier.

31. A method of latching a pivotable access door in a closed position comprising:

causing a striker member to engage and rotate a catch member about a first axis defined within a latch housing; and shifting the catch member relative to the latch housing about a second axis, which is spaced from the first axis, in order to retain the striker member within the latch housing.

32. The method of claim 31, further comprising: guiding the striker member into a latch housing along a beveled peripheral portion of an opening formed in the latch housing.

33. The method of claim 31, further comprising: shifting the second axis relative to the latch housing upon latching of the pivotable access door.

34. The method of claim 33, further comprising:

pivoting a carrier, which rotatably supports the catch member about the first axis, following receipt of the striker within the latch housing; and actuating an electrical switch based on the pivoting of the carrier.

35. The method of claim 34, further comprising: delaying the actuating of the electrical switch until the striker member is fully retained by the catch member.

36. The method of claim 31, further comprising: biasing the catch member towards an unlatching position.

* * * * *